US005536388A

United States Patent [19]

Dinan et al.

[11] Patent Number: 5,536,388

[45] Date of Patent: Jul. 16, 1996

[54] VERTICAL ELECTROETCH TOOL NOZZLE AND METHOD

[75] Inventors: Thomas E. Dinan, Poughkeepsie; Kirk G. Berridge, Fishkill; Madhav Datta, Yorktown Heights; Thomas S. Kanarsky; Michael B. Pike, both of Hopewell Junction; Ravindra V. Shenoy, Peekskill, all of N.Y.

[73] Assignee: International Business Machines Corporation, Armonk, N.Y.

[21] Appl. No.: 460,439

[22] Filed: Jun. 2, 1995

[51] Int. Cl.[6] ..... C25F 3/14; C25F 7/00

[52] U.S. Cl. ..... 205/670; 205/672; 205/686; 204/224 M

[58] Field of Search ..... 204/129.7, 724 M, 204/129.6; 205/670, 672, 686

[56] References Cited

U.S. PATENT DOCUMENTS

| | | | |
|---|---|---|---|
| 3,409,524 | 11/1968 | Olson | 205/672 X |
| 4,082,638 | 4/1978 | Jumer | 204/224 M |
| 4,174,261 | 11/1979 | Pellegrino | 204/273 X |
| 4,330,381 | 5/1982 | Jumer | 205/670 |
| 4,486,279 | 12/1984 | Fromson et al. | 204/129.7 X |
| 4,497,692 | 2/1985 | Gelchinski et al. | 205/92 |
| 4,539,069 | 9/1985 | Fishman et al. | 156/640 |
| 4,599,154 | 7/1986 | Bender et al. | 205/670 X |
| 4,620,894 | 11/1986 | Gurian et al. | 156/345 |
| 4,904,339 | 2/1990 | Diehl et al. | 156/640 |
| 5,169,477 | 12/1992 | Seki et al. | 156/345 |
| 5,186,796 | 2/1993 | Kelly et al. | 204/224 M X |
| 5,284,554 | 2/1994 | Datta et al. | 204/129.7 X |
| 5,290,384 | 3/1994 | Ketelhohn et al. | 156/345 |

*Primary Examiner*—Donald R. Valentine
*Attorney, Agent, or Firm*—Alison D. Mortinger

[57] ABSTRACT

A nozzle is provided for use in electroetching a vertically oriented workpiece, comprising a housing having a top, sides, and bottom for creating a flow of etching solution on the workpiece, and means for shaping the flow of etching solution into a moving channel to improve etch uniformity of the workpiece.

13 Claims, 6 Drawing Sheets

VERTICAL ELECTROETCH TOOL NOZZLE AND METHOD

RELATED APPLICATIONS

This invention is related to U.S. patent application Ser. No. 08/346,996, filed Nov. 30, 1994, now U.S. Pat. No. 5,486,282, entitled "Electroetching Process and Tool for Seed Layer Removal in Electrochemical Fabrication of Lead-Tin C4s," assigned to the present assignee and which is incorporated by reference in its entirety.

FIELD OF THE INVENTION

This invention is directed to electroetching, and more particularly to a nozzle for electroetching of a workpiece oriented in a vertical position.

BACKGROUND OF THE INVENTION

Copending application Ser. No. 08/346,996 describes a Vertical ElectroEtch Tool (hereafter referred to as VEET) used in the electrochemical fabrication of C4s (Controlled Collapse Chip Connections, also known as solder bumps or flip chip) for semiconductor substrates. One use for the VEET is to etch metal films which constitute layers of the ball limiting metallurgy (BLM) for the C4s by using the solder as a mask. In the electroetching process as applied to a wafer with the VEET, a metal layer on the wafer is made an anode, the VEET nozzle a cathode, and an electrolyte solution contacts the cathode and the anode to form an electrochemical cell.

FIG. 1 illustrates a nozzle assembly 126 which can be used with a VEET or a HEET (Horizontal ElectroEtching Tool). A plate 128 on the nozzle 126 acts as a cathode and is electrically connected by conventional means to a power supply (not shown). The nozzle includes two hollow portions 140 and 142, and fitting 132 which is connected to a flexible hose 130. Electrolyte solution is pumped from a reservoir (not shown) through the hose and nozzle, and exits the front of the nozzle through holes 129 in plate 128.

The nozzle assembly 126 is fixed to a bracket 112 which moves axially as threaded rod 113 is rotated by drive 114. The nozzle assembly may be moved by any other conventional mechanism as well as by that shown in FIG. 1. The nozzle may be scanned across a workpiece either back and forth or uni-directional generally indicated by arrows 115, and the scan speed is adjustable.

FIG. 2 illustrates the nozzle 126 in operation in a VEET. A wafer 200 is positioned vertically in a fixture 202 and held to face plate 203 by clips 204. Voltage is applied to the wafer (via the face plate and the clips) and to plate 128, and electrolyte solution 206 flows under pressure through the nozzle. A linear jet of etching solution is thus created as the nozzle 126 is scanned in the direction of arrow 208, and gravity causes the solution 206 to flow downward in the direction of arrows 210.

A problem (thoroughly discussed in the copending application) that occurs with vertical electroetching is excessive and uncontrolled undercutting of the layers of metal in the BLM, i.e. that they will be overetched horizontally under the solder which functions as a mask during etching. Undercutting to some extent is desirable, and control of the undercut allows control of the diameter of the BLM underneath the solder. However, with only partial contact between the plate 128 and the electrolyte solution 206, etching is inefficient and more severe etching conditions such as slower nozzle speed and higher voltages are required in order to remove the BLM in between C4s. These severe conditions result in uncontrolled undercutting.

In an attempt to control undercutting, the electrolyte chemistry and the voltage application were optimized. However, the uncontrolled undercut problem persisted, and was exacerbated by stray currents as the etching solution 206 flowed downward from the nozzle 126 and across the wafer 200, causing a streaking effect.

Thus there remains a need for a vertical electroetching tool which provides full contact between the nozzle and the eletrolyte solution and avoids streaking of the etching solution so that controlled undercutting is possible.

SUMMARY OF THE INVENTION

It is therefore an object of the present invention to provide an apparatus for controlled undercutting with vertical electroetching.

It is another object to provide a vertical electroetching tool nozzle for full contact between the etching solution and the nozzle.

It is a further object to provide a nozzle that minimizes undercutting caused by streaking of the etching solution.

In accordance with the above listed and other objects, a nozzle is provided for use in electroetching a vertically oriented workpiece, comprising a housing having a top, sides, and bottom for creating a flow of etching solution on the workpiece, and means for shaping the flow of etching solution into a moving channel to improve etch uniformity of the workpiece.

BRIEF DESCRIPTION OF THE DRAWINGS

These and other features, aspects, and advantages will be more readily apparent and better understood from the following detailed description of the invention, in which.

DESCRIPTION OF THE PREFERRED EMBODIMENTS

The present invention is described herein in the context of the VEET nozzle as described in copending application Ser. No. 08/346,996, now U.S. Pat. No. 5,486,282 as a specific example, and is not meant to limit applicability of the invention to that particular apparatus. Those skilled in the art will understand that the invention is broadly applicable to any apparatus in which it is desirable to electroetch a workpiece in a vertical position by using a nozzle to direct etching solution against the workpiece.

Figure 3:
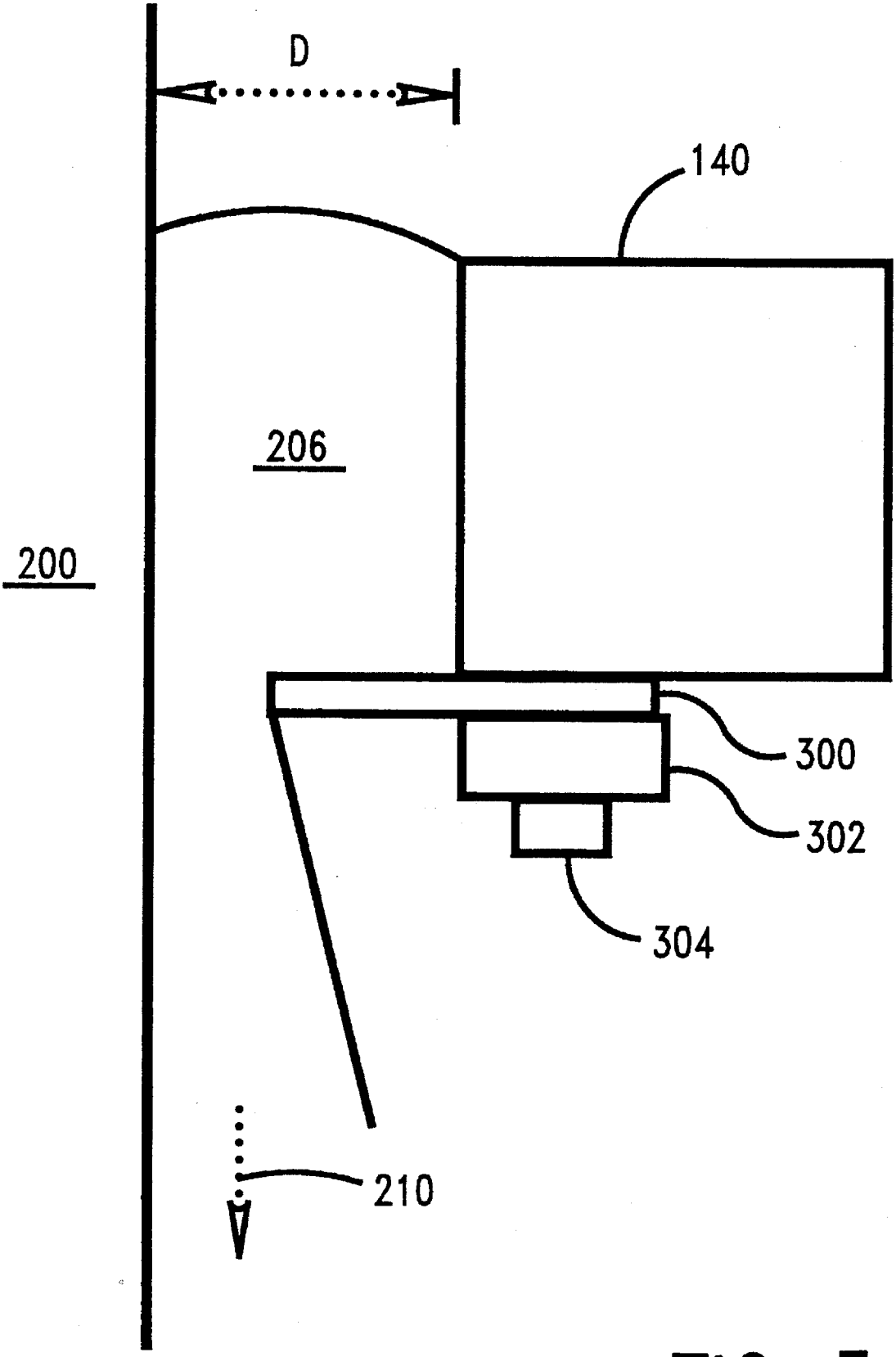
FIG. 3 is a side view of the nozzle with a flexible bottom dam.

Referring now to the drawings and more particularly to FIG. 3, the portion 140 of a nozzle 126 proximate the workpiece is shown with a flexible bottom dam. (Note that for clarity plate 128 is not shown in FIGS. 3 through 6.) Dam 300 is preferably the same or larger width as wafer 200 and preferably long enough to be securely attached to nozzle portion 140, for example with glue or with a clamp 302 and bolt 304 as shown. Note that any conventional fastening means can be substituted for the clamp and bolt arrangement, and dam 300 can be fastened to the front of nozzle portion 140 as well so long as the flow of etching solution 206 is not impeded. Alternately, dam 300 could be fabricated as part of the nozzle assembly. Bottom dam 300 restricts and shapes the flow of etching solution 206 vertically into a channel which fully contacts the nozzle portion 140 and moves as nozzle 126 is scanned across wafer 200. The flow of solution 206 downward as indicated by arrow 210 is markedly decreased, as the excess solution now flows primarily off the ends of bottom dam 300 away from wafer 200. Because solution 206 more fully contacts nozzle portion 140, etching is more efficient, etching conditions can be less severe (i.e. the nozzle speed and voltage can be more moderate) and still fully etch as intended, and thus undercutting can be more easily controlled. In addition, less solution 206 streaks wafer 200 below nozzle portion 140, less stray current is created, and undercutting control is enhanced.

Figure 1:
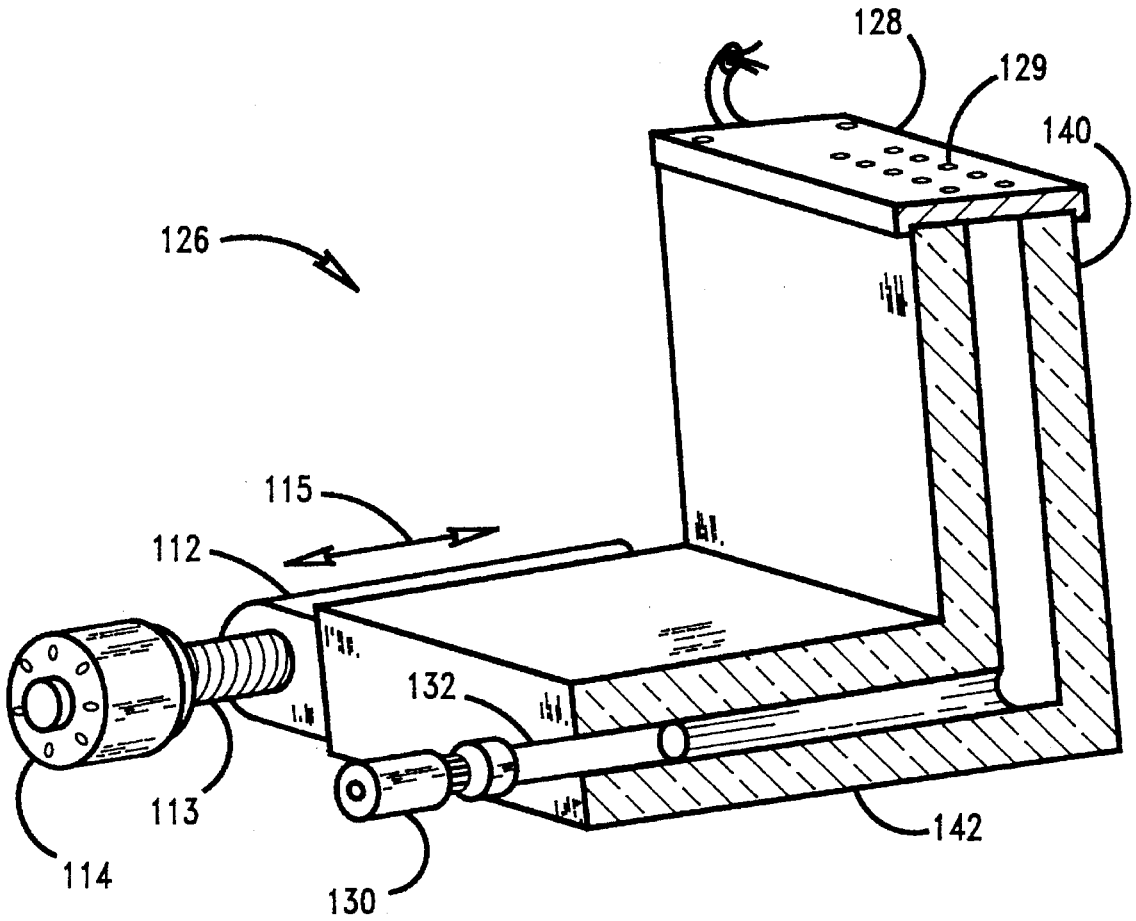
FIG. 1 is a perspective view (with partial cross section) of a vertical electroetch tool nozzle assembly without any means for modifying the flow of the etching solution.
Figure 2:
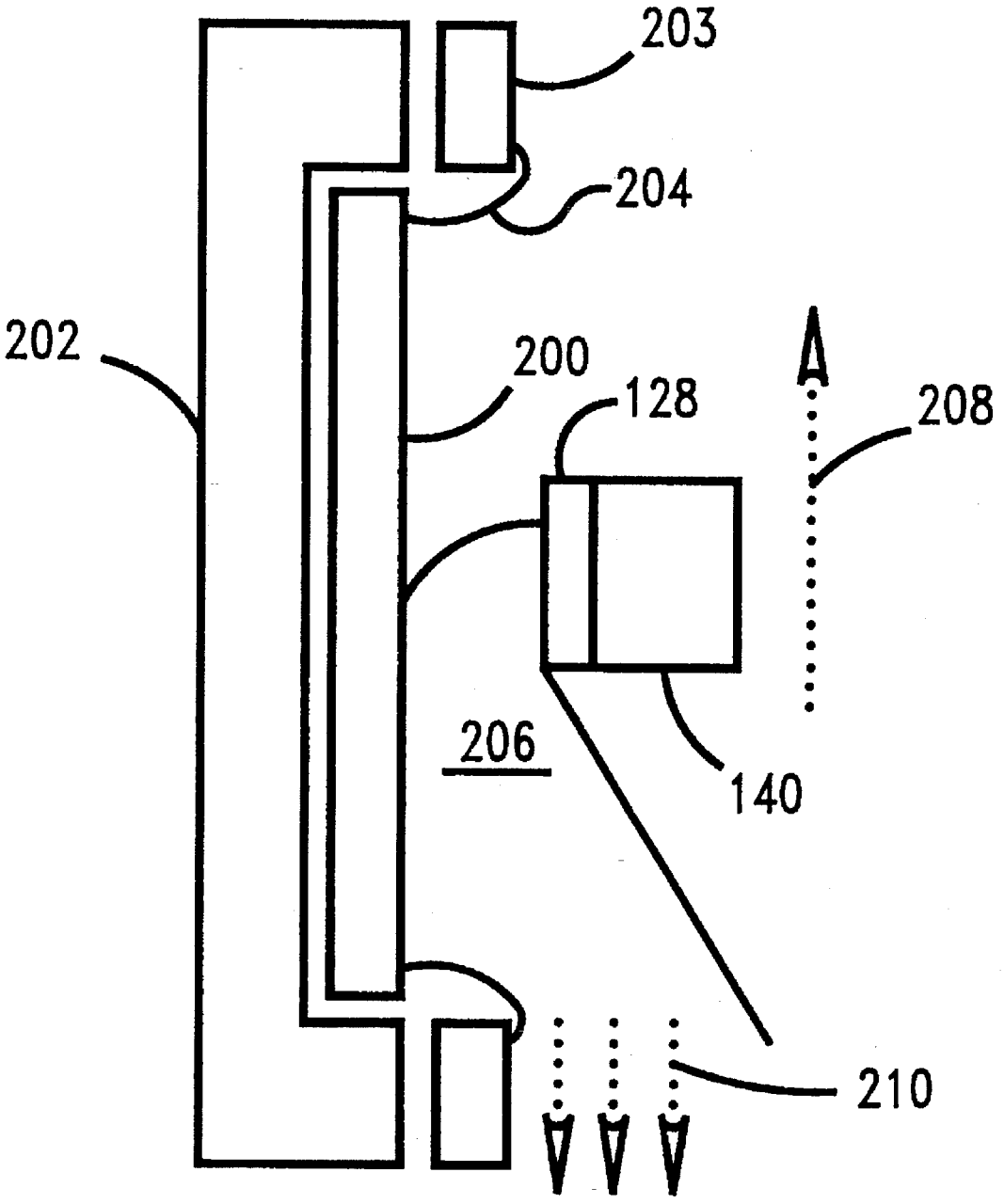
FIG. 2 is a side view of the nozzle of FIG. 1 etching a wafer.

Bottom dam 300 either spans the entire distance D between the nozzle and the wafer, or slightly less. The bottom dam can be made of virtually any material that is inert with respect to etching solution 206, and also will not be consumed by the etching solution, which is a mixture of potassium sulfate and glycerol in water. Additionally, the bottom dam is preferably electrically non-conductive, either composed of non-conductive material or coated with a non-conductive coating. In practice, a thin film of plastic approximately 4 mils thick has been used as dam 300 with good results. The flexibility of the film allows dam 300 to move freely over clips 204 that hold wafer 200 in place as shown in FIG. 2. In general, flexible dam 300 should have sufficient elasticity so that dam 300 will flex rather than crack in operation, yet be rigid enough to obstruct the flow of etching solution 206.

Figure 4:
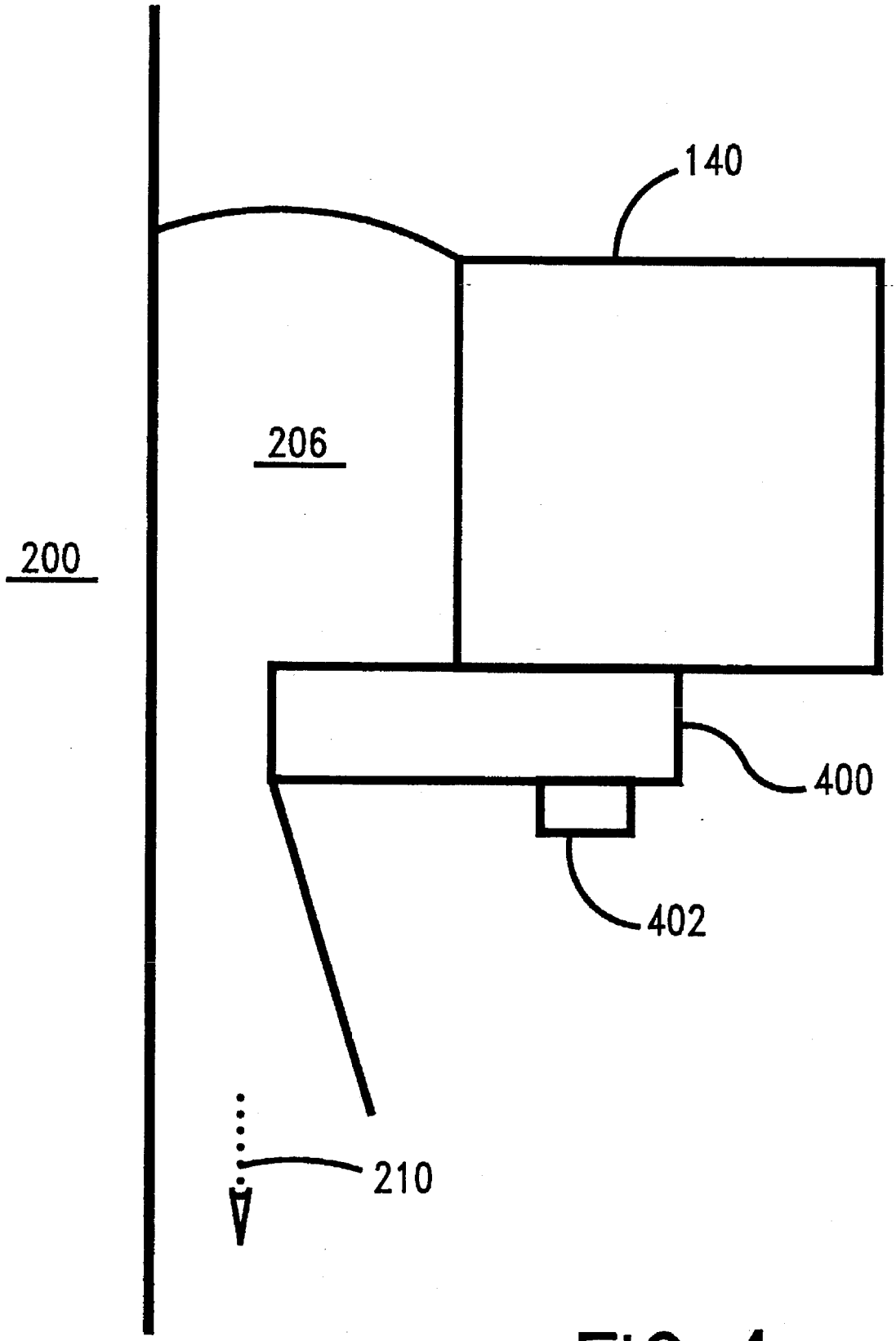
FIG. 4 is a side view of the nozzle with a rigid bottom dam.

FIG. 4 shows an alternate design for the bottom dam. A rigid dam 400 is fastened to the bottom of nozzle portion 140 by a bolt 402. Like flexible dam 300, any conventional fastening means can be substituted for bolt 402, and dam 400 can also be fabricated as part of the nozzle assembly. Rigid dam 400 is thicker than flexible dam 300 and is less prone to wear, which promotes process uniformity in manufacturing. However, rigid dam 400 cannot be positioned as close to wafer 200 as flexible dam 300 because dam 400 will not move freely over clips 204.

Figure 5:
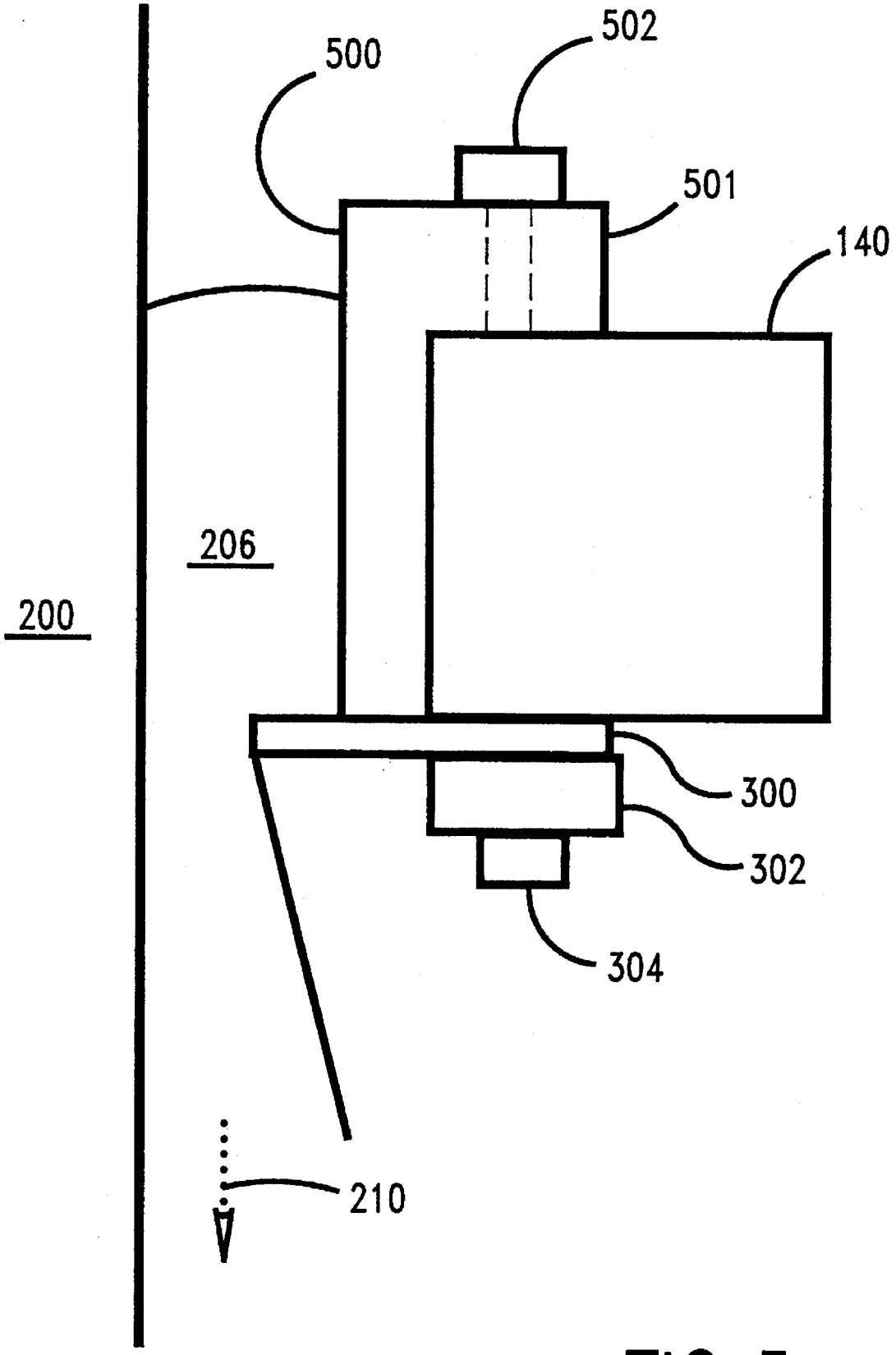
FIG. 5 is a side view of the nozzle with a side dam.

In FIG. 5, a side obstruction has been added to the nozzle assembly shown in FIG. 3. As shown, side dam 500 has a top portion 501 so that it can be securely fastened to the top of nozzle portion 140 by bolt 502. However, top portion 501 is not required, and side dam 500 can be attached to nozzle portion 140 by any conventional means, including gluing. Side dam 500 is preferably made of a material like dam 300 (or dam 400), and like bottom dam 300 either spans entire distance D between nozzle portion 140 and wafer 200, or slightly less. Note that although FIG. 5 shows side dam 500 projecting from nozzle portion 140 less than bottom dam 300, other configurations are possible and may be preferable depending on the etch conditions. With one side dam, etching solution 206 will primarily flow off the unobstructed side of bottom dam 300.

Figure 6:
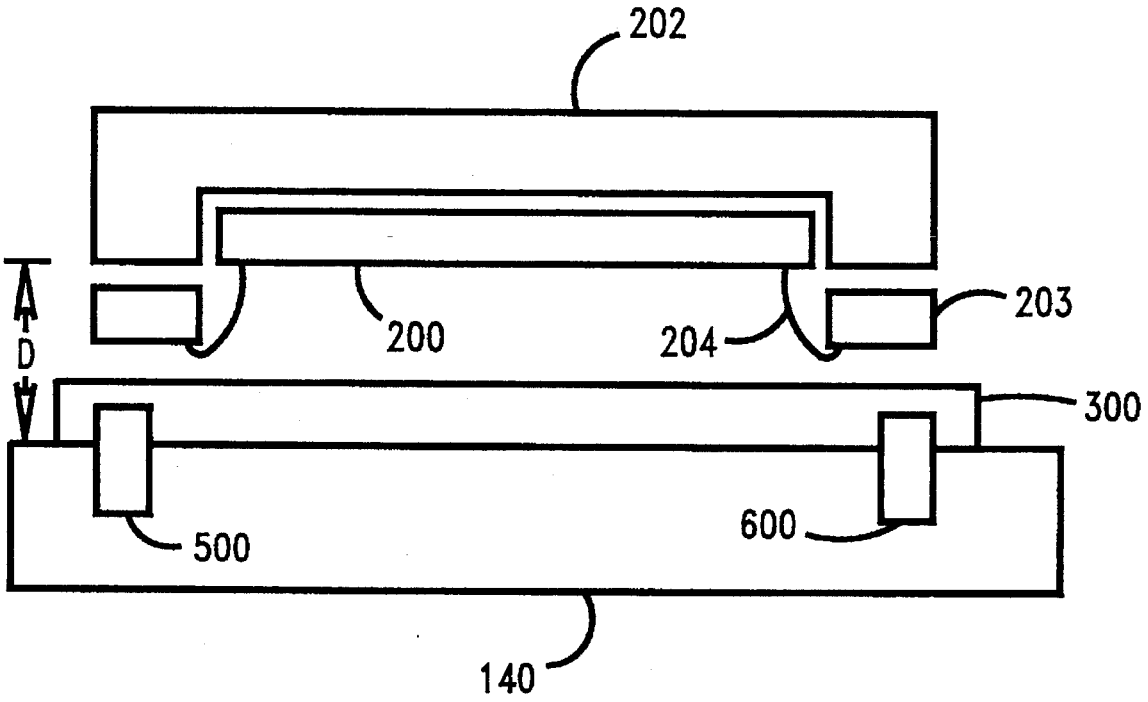
FIG. 6 is a top view of the nozzle with a bottom dam and two side dams, all in accordance with the present invention.

A second side obstruction 600 can be added as shown in the top view of the nozzle in FIG. 6. Side dams 500 and 600 (or either dam singly) are preferably positioned at points along nozzle portion 140 so that each dam faces fixture 202 and not wafer 200, and also such that the side dams will not contact clips 204. With two side dams, etching solution 206 (not shown) will primarily flow up over the top of nozzle portion 140, providing the fullest possible contact between the cathode and the anode, and minimizing the downward flow of solution over wafer 200.

In summary, the use of bottom and side dams in conjunction with the vertical electroetch tool nozzle described has resulted in significant improvements to the vertical electroetching process. The resulting apparatus allows for controlled undercutting and improved uniformity of films on the wafer by providing full contact between the etching solution and the nozzle, and minimizing streaking of the etching solution below the nozzle, thereby minimizing stray currents.

While the invention has been described in terms of specific embodiments, it is evident in view of the foregoing description that numerous alternatives, modifications and variations will be apparent to those skilled in the art. Thus, the invention is intended to encompass all such alternatives, modifications and variations which fall within the scope and spirit of the invention and the appended claims.

What is claimed is:

1. A nozzle for use in electroetching a vertically oriented workpiece by moving the nozzle vertically with respect to the workpiece, comprising:

a housing having a top, sides, bottom, and front for creating a flow of etching solution issuing from the front of the housing and impinging directly on the workpiece, the front of the housing being a cathode; and means for shaping the flow of etching solution into a moving channel to improve etch uniformity of the workpiece.

2. The apparatus of claim 1 wherein the shaping means comprises damming means attached to the housing for providing a damming action to the flow of etching solution.

3. The apparatus of claim 2 wherein the damming means comprises a bottom dam fastened to the bottom of the housing such that the flow of etching solution is shaped vertically.

4. The apparatus of claim 3 wherein the bottom dam is a flexible, electrically non-conductive material.

5. The apparatus of claim 3 wherein the bottom dam is a rigid, electrically non-conductive material.

6. The apparatus of claim 3, wherein the damming means further comprises at least one side dam fastened to the housing such that the flow of etching solution is shaped horizontally.

7. The apparatus of claim 6 wherein the side dam is an L-shaped member with a horizontal portion contacting the top of the nozzle and a vertical portion contacting the front of the nozzle.

8. The apparatus of claim 6 wherein the side dam is attached to the side of the nozzle.

9. A nozzle for use in electroetching a vertically oriented workpiece by moving the nozzle vertically with respect to the workpiece, comprising:

a housing having a top, sides bottom and front for creating a flow of etching solution issuing from the front of the housing and impinging on the workpiece;

a bottom dam fastened to the bottom of the housing for vertical shaping of the flow of etching solution; and two side dams fastened to the housing for horizontal shaping of the flow of etching solution, the two side dams being spaced apart at a distance larger than the width of the workpiece plus means used to conduct current to the workpiece.

10. The apparatus of claim 1 wherein neither the nozzle nor the shaping means contact the workpiece.

11. A method of electroetching a vertically oriented workpiece by moving a nozzle vertically with respect to the workpiece, the nozzle having a side proximate the workpiece being a cathode, comprising the steps of:

creating a moving channel of electrolyte solution issuing from the nozzle and impinging directly against the workpiece; and damming the flow of the electrolyte solution in a vertical direction.

12. The method of claim 11 further comprising the step of damming the flow of electrolyte solution in a horizontal direction.

13. The method of claim 11 wherein neither the nozzle nor the shaping means contact the workpiece.

* * * * *